US009656824B2

(12) United States Patent
Jendroska et al.

(10) Patent No.: US 9,656,824 B2
(45) **Date of Patent: *May 23, 2017**

(54) REEL HANDLING SYSTEM FOR A WINDER, AND METHOD IN THIS REGARD

(71) Applicant: Windmöller & Hölscher KG, Lengerich (DE)

(72) Inventors: Rainer Jendroska, Ladbergen (DE); Tristan Zesiger, Osnabrück (DE)

(73) Assignee: Windmöller & Hölscher KG, Lengerich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/891,313

(22) PCT Filed: Mar. 13, 2014

(86) PCT No.: PCT/EP2014/053761
§ 371 (c)(1),
(2) Date: Nov. 13, 2015

(87) PCT Pub. No.: WO2014/183889
PCT Pub. Date: Nov. 20, 2014

(65) Prior Publication Data

US 2016/0107860 A1 Apr. 21, 2016

(30) Foreign Application Priority Data

May 13, 2013 (DE) ..... 10 2013 104 908
Aug. 15, 2013 (DE) ..... 10 2013 108 829

(51) Int. Cl.
*B65H 19/30* (2006.01)
*B65H 19/28* (2006.01)
*B65H 75/24* (2006.01)

(52) U.S. Cl.
CPC ..... *B65H 19/305* (2013.01); *B65H 19/283* (2013.01); *B65H 75/243* (2013.01);
(Continued)

(58) Field of Classification Search
CPC ..... B65H 19/2284; B65H 19/30; B65H 2301/4148; B65H 2301/41496;
(Continued)

(56) References Cited

U.S. PATENT DOCUMENTS 2,198,644 A * 4/1940 Wettengel ..... B21C 47/24 193/36
3,695,539 A * 10/1972 Lindstaedt ..... B65H 16/021 198/432
(Continued)

FOREIGN PATENT DOCUMENTS

DE 1 604 659 A 12/1970
DE 26 54 707 A1 6/1978
(Continued)

OTHER PUBLICATIONS

International Search Report, mailing date May 27, 2014 for corresponding International Application No. PCT/EP2014/053761.
(Continued)

*Primary Examiner* — William A Rivera
(74) *Attorney, Agent, or Firm* — Intellectual Property Law Group LLP

(57) ABSTRACT

The invention relates to a reel handling system for a winder (50), in which bobbins (1) with a material web (2) can be applied, with the result that a plurality of reels (3) which are wound on the bobbins (1) with a material web (2) are produced, having a feed unit (10), in order to transfer a plurality of bobbins (1) to a receiving unit (20), wherein the receiving unit (20) is arranged movably between the feed unit (10) and a transfer station (60), by way of which
(Continued)

receiving unit (20) bobbins (1) can be transferred to the winder (50) and reels (3) can be transferred from the winder (50) to the transfer station (60), wherein a positioning device (80) is provided between the transfer station (60) and the feed unit (10), which positioning device (80) brings about positioning of the bobbins (1) during the movement of the receiving unit (20) in the direction of the transfer station (60).

19 Claims, 14 Drawing Sheets

(52) U.S. Cl.
CPC ..... *B65H 2301/4148* (2013.01); *B65H 2301/41829* (2013.01)

(58) Field of Classification Search
CPC .... B65H 2301/4172; B65H 2301/4173; B65H 2301/41734; B65H 2301/414745; B65H 2301/41814; B65H 2301/41818; B65H 2301/41828; B65H 2301/41816; B65H 2408/23152; B65H 2405/422; B65H 19/305; B65H 75/243; B65H 19/283; B65H 2301/41829
See application file for complete search history.

(56) References Cited

U.S. PATENT DOCUMENTS 3,718,303 A * 2/1973 Mount ..... B21C 47/24 242/533
3,727,853 A * 4/1973 Kinoshita ..... B29C 53/32 242/532.3
4,208,019 A * 6/1980 Dusenbery ..... B65H 19/2284 242/527.2
4,466,577 A * 8/1984 Heinz ..... B65H 19/1868 242/541
4,840,321 A * 6/1989 Focke ..... B65H 16/04 242/422.3
5,352,319 A * 10/1994 Ishizu ..... B65H 19/22 156/184
5,759,326 A * 6/1998 Vigneau ..... B65H 19/29 156/187
5,941,474 A * 8/1999 Cushing ..... B65H 19/2215 242/530.1
9,346,651 B2 * 5/2016 Ludwig ..... B65H 67/0411
2007/0246595 A1 * 10/2007 Tsai ..... B65H 19/2269 242/532.3
2009/0134264 A1 5/2009 Simonelli
2010/0025516 A1 * 2/2010 Barsacchi ..... B25J 15/0616 242/533.2
2011/0011971 A1 * 1/2011 Thepaut ..... B65H 19/305 242/473.5
2016/0083212 A1 * 3/2016 Jendroska ..... B65H 19/305 242/533.7
2016/0114996 A1 * 4/2016 Jendroska ..... B65H 19/305 242/533.7

FOREIGN PATENT DOCUMENTS

DE 28 47 556 A1 11/1978
DE 1 803 309 A 7/2002
DE 10 2010 041 696 A1 4/2012
EP 1295 832 A2 3/2003
EP 2123584 A1 11/2009
EP 2 636 622 A2 9/2013
JP H 11 116107 A 4/1999
WO WO 03/010078 A1 2/2003
WO WO 03/010079 A1 2/2003
WO WO 03/010079 A1 2/2003

OTHER PUBLICATIONS

Written Opinion of the ISA, mailing date May 27, 2014 for corresponding International Application No. PCT/EP2014/053761.
German Office Action, dated Apr. 4, 2014 for corresponding German Patent Application 10 2013 108 829.5.

* cited by examiner

REEL HANDLING SYSTEM FOR A WINDER, AND METHOD IN THIS REGARD

CROSS-REFERENCE TO RELATED APPLICATIONS

This application is a U.S. National Phase application, under 35 U.S.C. §371, of International Application no. PCT/EP2014/053761, with an international filing date of Mar. 13, 2014, and claims benefit of German Application no. 20 2013 104 908.7 filed on May 13, 2013 and German Application No. 10 2013 108 829.5 filed on Aug. 15, 2013, which are hereby incorporated by reference for all purposes.

BACKGROUND OF THE INVENTION

1. Field of the Invention

The invention relates to a reel handling system for a winder which is impingeable with tubes having a material web, such that a plurality of reels of tubes having a material web wound thereon are created. The invention moreover relates to a method for an aforementioned reel handling system.

2. Background

WO 03/010079 A1 discloses a device in which a material web can be applied onto a rotating tube in a winder. A reel which has a tube with the material web wound thereupon and which may be conveyed away from the winder by a reel handling system is created. It is a significant disadvantage in the prior art that the reel handling system is capable of "processing" or moving, respectively, in each case only one tube or reel, respectively. Moreover, it has proven to be disadvantageous that the device known in the prior art is complex in its construction.

SUMMARY OF THE INVENTION

It is the object of the present invention to avoid the above-mentioned disadvantages and in particular to provide a reel handling system for a winder and a method therefor, such that the productivity of the overall assembly and of the method may be significantly increased.

The object of the present invention is achieved by a reel handling system having all the features of patent claim 1. The mentioned object is furthermore achieved by a method having all the features of patent claim 20. Potential embodiments of the invention are described in the respective dependent claims.

According to the invention, a reel handling system for a winder which is impingeable with tubes having in each case one material web is proposed, such that a plurality of reels of tubes having in each case one material web wound thereon are created, the reel handling system having an infeed unit for transferring a plurality of tubes to a receptacle unit, wherein the receptacle unit is disposed so as to be movable between the infeed unit and a transfer station by way of which tubes are consignable to the winder and reels is transferable from the winder to the transfer station, wherein a position installation which effects positioning of the tubes when the receptacle unit is moved in the direction of the transfer station is provided between the transfer station and the infeed unit. It is a significant advantage of the invention that a plurality of tubes which inter alia are impinged by the material webs and in the case of which a multiplicity of reels are thus created can be processed in the reel handling system, on account of which the productivity of the overall assembly may be significantly increased. On account of the simultaneous processing of a plurality of tubes or reels, respectively, the present invention has a position installation which lies between the transfer station and the infeed unit. In order to ensure that the material web is correctly applied to the tubes, it has been found that the precise position of the tubes within the transfer station is required. It is only in this way that high quality can be ensured when the material web is applied onto the individual tube. Since a plurality of tubes have to be conveyed into the winder, the position installation makes for the tubes to be brought into their correct position while the receptacle unit is moved in the direction of the transfer station. According to the invention, positioning of the tubes is performed while the receptacle unit is moved in the direction of the transfer station. The position installation here positions the tubes on the moving receptacle unit. Should the tubes which are disposed so as to be mutually adjacent already be in the transfer station, it is no longer required according to the invention that the position of the tubes is readjusted or corrected, respectively. Consigning the tubes from the transfer station to the winder may be performed without loss of time.

In one further measure which improves the invention it may be provided that the position installation is configured in such a manner that positioning of the tubes is performed in a mutually relative manner. The spacing from the tubes which are disposed so as to be mutually adjacent may be correspondingly corrected and adjusted during positioning, for example, wherein each tube is simultaneously positioned on the receptacle unit in a corresponding manner by way of the position installation. On account thereof, automatic reel changing which requires little time may be generated. At the same time the machine operating speeds, in particular in the case of the winder, may be increased, leading to higher productivity.

For applying an adhesive medium to the tubes an adhesive bonding device may be advantageously disposed between the infeed unit and the transfer station. Various adhesive media may be employed here. This depends inter alia on the material of the material web and/or of the tube. The adhesive medium serves for reliably fastening the material web which is applied in the winder to the tube. It is particularly advantageous that the adhesive bonding device may be integrated in the position installation, on account of which a compact overall assembly of the reel handling system is achieved.

It is moreover conceivable for the position installation to have a temperature-control unit for the adhesive medium and/or a pressurized unit for applying the adhesive medium. A hot-melt adhesive may be employed as an adhesive medium, for example, on account of which good adhesive properties may be achieved. It has moreover been found that a pressurized unit which makes for the adhesive medium to be applied to the tubes at a defined pressure may be advantageous. On account thereof, the quantity of the adhesive medium being employed inter alia may be reduced or optimized, respectively.

Moreover, it is conceivable in the context of the inventive concept that the position installation has a sensor unit which checks the tubes passing by, in particular checks whether the tubes bear correctly on the receptacle unit and/or the correct tubes are located on the receptacle unit. The sensor unit may thus detect the position of the respective tube on the receptacle unit. By way of determining the diameter of the tube bearing on the receptacle unit the reel handling system may detect to what extent the infeed unit has transferred the correct tube to the receptacle unit. Should the sensor unit detect that the tube does not bear correctly on the receptacle unit or the correct tube is not located in the receptacle unit, the method according to the invention using the mentioned reel handling system is aborted, the method being explained in more detail herebelow. The sensor unit can also detect whether a tube is missing.

The position installation may advantageously have a wiper element which serves for contacting at least one tube while the receptacle unit is moved in the direction of the transfer station. The position installation here is displaceable; in particular, the position installation may assume an operating position when the receptacle unit having the tubes is moved in the direction of the transfer station, and may assume a standby position which differs from the operating position, when the receptacle unit having the reels is moved. When the receptacle unit is moved in the direction of the transfer station, the wiper element contacts the tubes and correctly positions the latter on the receptacle unit. Advantageously, the wiper element during positioning of the tubes on the receptacle unit is located so as to be immovable on the position installation. Expediently, the wiper element at least partially projects into the displacement path of the tubes in the direction of the transfer station, such that one or all tubes automatically impact the wiper element and are thus positioned in the receptacle unit.

In the case of one measure which improves the invention, the transfer station may have a supporting device on which a winding shaft is releasably fastened, wherein the tubes are capable of being push-fitted onto the winding shaft when the receptacle unit is moved in the direction of the transfer station. Should the tubes be located entirely on the winding shaft and in their correct orientation thereon, the supporting device releases the fastening on the winding shaft which is subsequently infed to the winder. Moreover, the winding shaft having reels placed thereupon may be handed back to the transfer station again, wherein after transfer the supporting device closes the fastening in relation to the winding shaft again, so that the reels by way of a movement of the receptacle unit may be conveyed away back to a reel discharge.

In order for the tubes to be able to be reliably push-fitted onto the winding shaft and/or for the reels to be readily conveyed from the winding shaft in the direction of the reel discharge, the winding shaft on one side is mounted on and/or fastened to the supporting device. In particular, the mounting of the winding shaft is disposed on that side of the supporting device that faces away from the infeed unit.

In order for the positioning of the tubes on the winding shaft in terms of precision to be further improved, the winding shaft in relation to the horizontal axis may be downwardly inclined, such that the winding shaft in relation to the horizontal axis is inclined at an angle $\alpha$, wherein the angle $\alpha$ in particular is $\leq 5°$. For example, it is conceivable for the free end of the winding shaft that faces the infeed unit to be downwardly inclined. On account of the slightly oblique arrangement of the winding shaft in relation to the horizontal axis or the direction of movement of the receptacle unit, respectively, the winding shaft is driven through the individual tubes which have the shape of a hollow cylinder. At the same time, there is slight contact between the sleeve face of the obliquely disposed winding shaft and the inside sleeve face of the tube, on account of which the tube as a result of the friction being created is imparted additional positioning.

The reel handling system according to the invention may furthermore provide that the sensor unit is disposed between the wiper element and the adhesive bonding device. Since the tubes ahead of the wiper element do not yet lie in the receptacle unit in a positioned manner, it is advantageous for the sensor unit to be positioned downstream of the wiper element or behind the wiper element, respectively. Should the sensor unit continue to detect incorrect positioning of the tube or tubes, or should the sensor unit detect that there is no tube or an incorrect tube lying in the receptacle unit, the operation of applying an adhesive medium by means of the adhesive bonding device is prevented.

It may be furthermore provided according to the invention that the receptacle unit has a first bearing face having positioning means, so as to align the tubes in the receptacle unit by means of the position installation. Advantageously, the tubes after infeeding to the receptacle unit bear obliquely on the first bearing face, since the tubes are in each case located on a positioning means that extends in a protruding manner from the bearing face, for example. During positioning by means of the position installation the wiper element contacts at least one or a plurality of tubes which are moved across the receptacle unit moving in the direction of the transfer station, wherein the tube are simultaneously pushed aside by the positioning means and uniform bearing of the tubes on the first bearing face arises. Since the bearing face has a multiplicity of positioning means which are disposed so as to be mutually spaced apart, contacting at least the one tube or the multiplicity of tubes by way of the wiper element achieves that the tube or the plurality of tubes come into contact with an assigned positioning means, wherein this positioning means likewise may extend in a protruding manner from the first bearing face.

Moreover, the reel handling system according to the invention may be embodied such that the receptacle unit has a second bearing face for receiving the reels, in particular such that the second bearing face is movable independently of the receptacle unit. It may be helpful here for two different bearing faces to be provided on the receptacle unit, since the tubes and the reels to be conveyed in terms of geometry are different. It may likewise be advantageous for the second bearing face to be able to be moved independently of a movement of the receptacle unit, for example when the winder transfers the reels to the transfer station. It is conceivable here that the second bearing face is moved by way of a lifting drive, so as to securely receive the winding shaft having the reels.

The invention furthermore includes that the receptacle unit is movable in a linear manner between the infeed unit and the transfer station, and/or has a lifting device by way of which the receptacle unit is movable in a perpendicular manner to the direction of movement between the infeed unit and the transfer station. The lifting device may be embodied in such a manner that both the first as well as the second bearing faces may be conjointly moved. It is likewise conceivable for the first and/or the second bearing face to have an independent lifting device. The invention furthermore includes that the receptacle unit when being moved in the direction of the transfer station and back therefrom has a displacement path which may be more complex than a linear displacement path; the displacement path may be embodied so as to be arcuate and/or to lie on a circular path, for example.

It may furthermore be advantageous for the receptacle unit to be disposed so as to be rotatable about an axis. Depending on the rotational position of the receptacle unit, the first or the second bearing face will be available to the reel handling system. An embodiment of this type of the rotating receptacle unit facilitates a compact overall assembly of the entire system.

The object is moreover achieved by a method according to all of the features of independent patent claim 20. Potential embodiments of the method according to the invention are described in the dependent claims.

According to the invention, a method for positioning tubes in a reel handling system is proposed, the reel handling system having an infeed unit for transferring a plurality of tubes to a receptacle unit, wherein the receptacle unit is disposed so as to be movable between the infeed unit and a transfer station, and a position installation which effects positioning of the tubes when the receptacle unit is moved in the direction of the transfer station is provided between the transfer station and the infeed unit. It is particularly advantageous that the multiplicity of tubes are positioned while being moved in the direction of the transfer station. It is particularly advantageous that a multiplicity of tubes may be processed by the reel handling system, wherein in one method step, all of the tubes are positioned before the tubes are further processed outside the transfer station. Further advantages of the method according to the invention correspond to the advantages which apply to the reel handling system according to the invention.

Moreover, it has been found to be advantageous for a winding shaft to be releasably fastened to the transfer station, wherein the tubes are push-fitted onto the winding shaft when the receptacle unit is moved in the direction of the transfer station and final positioning of the tubes on the winding shaft is hereby performed. The winding shaft here in relation to the horizontal axis may be inclined in such a manner that final positioning of the tubes on the winding shaft is performed while the tubes are push-fitted onto the winding shaft.

BRIEF DESCRIPTION OF THE DRAWINGS

Further advantages, features, and details of the invention may be derived from the following description in which a plurality of exemplary embodiments of the invention are described in detail with reference to the drawings. Here, the features mentioned in the claims and in the description may in each case be relevant to the invention both individually or in any arbitrary combination thereof. In the drawings:

DETAILED DESCRIPTION OF SPECIFIC EMBODIMENTS

Figure 1:
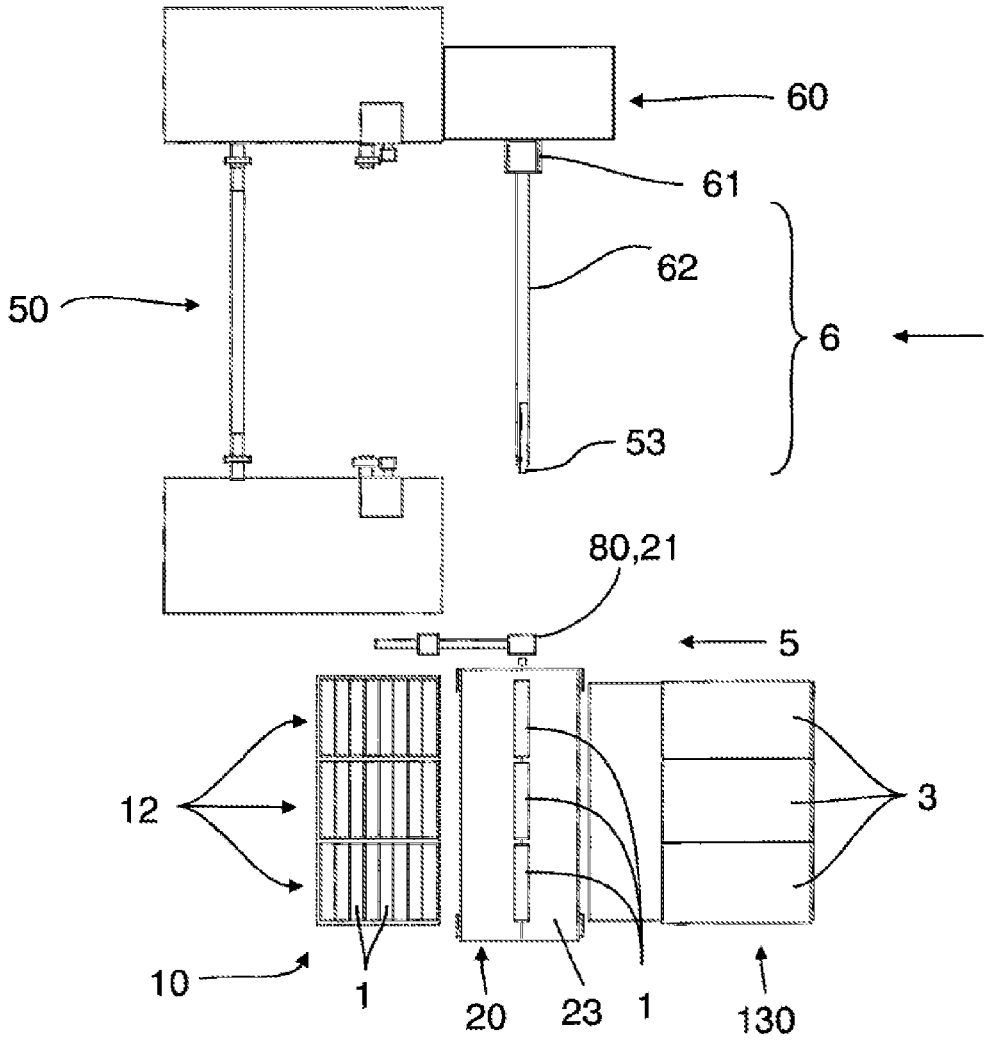
FIGS. 1 to 11 show schematic views of a reel handling system having a winder, an infeed unit, a receptacle unit, a transfer station, a position installation, and a reel discharge, wherein the reel handling system is in various operational states.

FIGS. 1 to 11 schematically show a reel handling system for a winder 50 in which tubes 1 having in each case one material web 2 may be wound. The reel handling system here comprises an infeed unit 10 for transferring a plurality of tubes 1 to a receptacle unit 20. According to FIG. 1, three reels 3 have already been transferred to the receptacle unit 20, wherein the receptacle unit 20 has a first bearing face 23 on which the tubes 1 bear. The tubes 1 here are configured so as to be cylindrical.

The receptacle unit 20 may be moved between the infeed unit 10 and a transfer station 60. The tubes 1 may be transferred to the winder 50 in the transfer station 60, to which further reference will be made in the following. In each case one material web 2 is applied onto each individual tube 1 in the winder 50, and a plurality of reels 3 of tubes 1 having a material web 2 wound thereonto results (cf. FIGS. 3 and 6, for example). The reels 3 are subsequently transferred again from the winder 50 to the transfer station 60 (shown in FIGS. 4 and 5).

A position installation 80 which effects positioning of the tubes 1 on the first bearing face 23 when the receptacle unit 20 is moved in the direction of the transfer station 60 is provided between the transfer station 60 and the infeed unit 10. The position installation 80 is configured in such a manner that positioning of the tubes 1 in a mutually relative manner is performed. The position installation 80 has a sensor unit 100 (illustrated in FIG. 12) wherein the sensor unit 100 checks the tubes 1 passing by as to what extent the tubes 1 correctly bear on the receptacle unit 20 and/or the correct tubes 1 are located on the receptacle unit 20. According to FIG. 12 the sensor unit 100 has a first sensor 110 which checks to what extent the diameter of the tube 1 in relation to a fixedly predetermined maximum diameter is excessive, so as to protect the downstream installation of the reel handling system. If the measured diameter of the tube 1 actually is larger than a memorized maximum diameter, the reel handling system is shut down.

The second sensor 120 checks to what extent the actual diameter of the tube 1 corresponds to a predetermined value within the reel handling system. For example, it is conceivable for the machine operator of the reel handling system to beforehand enter the value of the tube 1 in terms of its diameter. Subsequently a comparison between the measured diameter of the tube 1 and the previously entered diameter value is performed by way of the measurement of the second sensor. The sensor unit 100 which is disposed on the position installation 80 may thus also establish to what extent a tube 1 is missing, this likewise leading to the reel handling system being shut down. A wiper element 81, which according to the present exemplary embodiment is flexible and may be configured from spring steel, is located between the two sensors 110, 120. The position installation 80 furthermore has an adhesive bonding device 90 which is disposed in the direction toward the transfer station 60.

It is shown in FIGS. 12 to 15 that the receptacle unit 20 has positioning means 24 for aligning the tubes 1 in the receptacle unit 20 by means of the position installation 80. The first bearing face 23 of the receptacle unit 20 here has tray elements 26 which are at least partially adapted to the geometrical shape of the tubes 1. The tray elements 26 are mutually spaced apart, wherein the positioning means 24 project in a protruding manner from the bearing face 23; this can be particularly clearly seen from FIGS. 13 to 15. According to the present exemplary embodiment the positioning means 24 are configured in a disk-like manner, wherein the positioning means 24 are embodied as metallic disks which are disposed on the sides of the tray elements 26.

Figure 12:
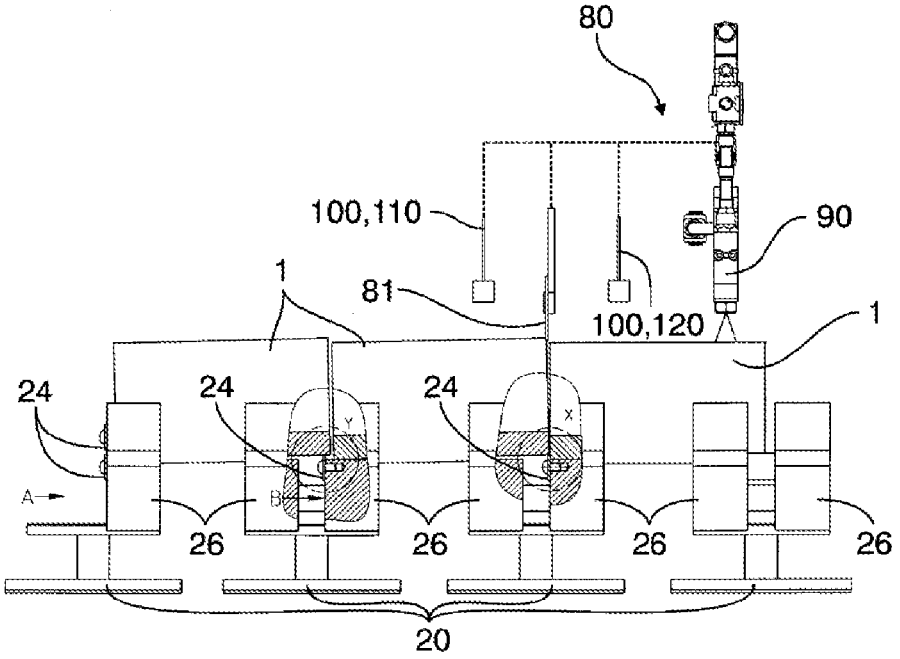
FIG. 12 shows a detailed view of the position installation.
Figure 13A:
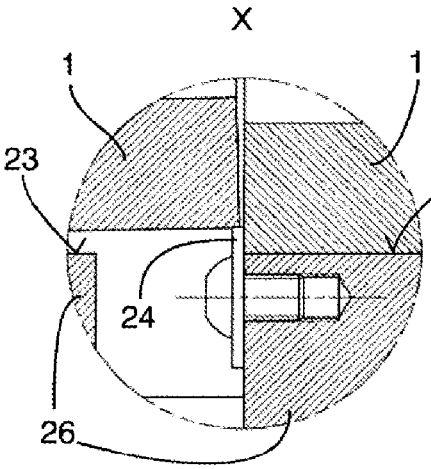
FIG. 13 shows an enlarged view according to FIG. 12.
Figure 13B:
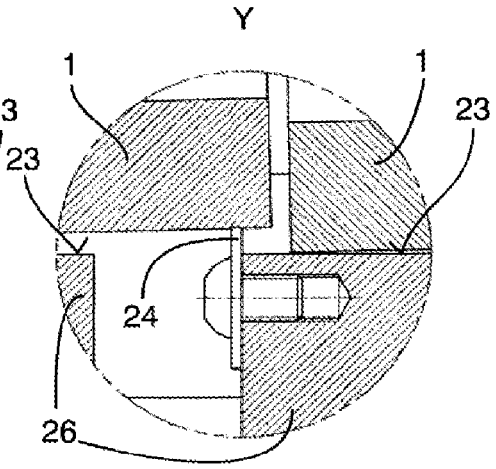
Figure 14:
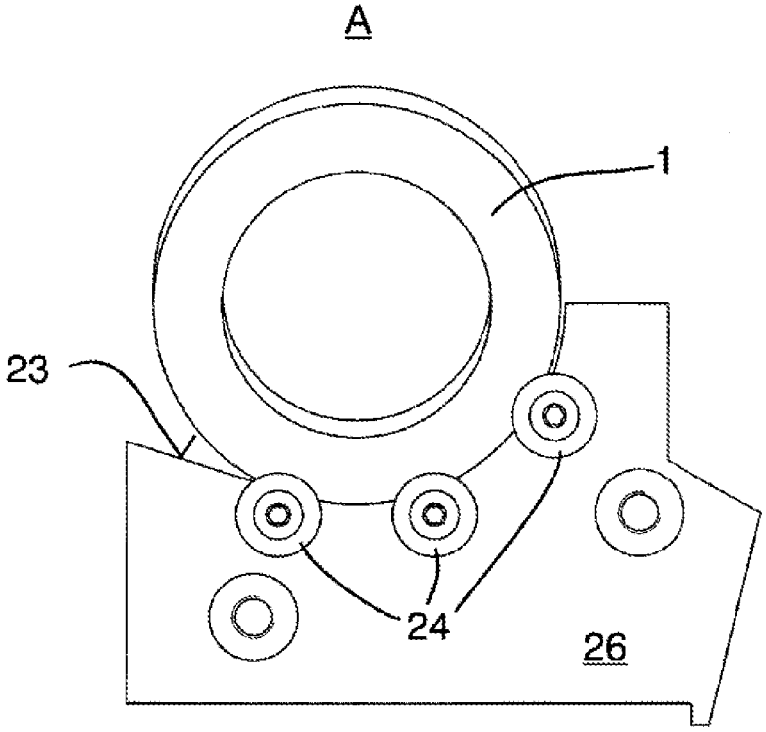
FIG. 14 shows a view A according to FIG. 12.

When the tubes 1 are transferred from the infeed unit 10 to the receptacle unit 20 (cf. FIG. 10), the tubes 1 according to FIG. 12 are in each case located on one or a plurality of positioning means 24, on account of which the tubes 1 have an oblique orientation on the first bearing face 23 of the receptacle unit 20; this can be clearly seen in FIG. 12. Should there now be movement of the receptacle unit 20 from the position according to FIG. 1 in the direction of FIG. 2, the wiper element 81 will contact each obliquely disposed tube 1, such that the tube 1 is taken from its oblique orientation and is pushed onto the bearing face 23 of the receptacle unit 20, on account of which first positioning 5 of the tubes 1 is performed. According to FIG. 12 the right-hand tube 1 has already been positioned above the wiper element 81, wherein the tube 1 by way of its left-hand region touches the positioning means 24 which is shown in FIG. 13*a*. The central tube 1 and the left-hand tube 1 are thus also positioned, wherein the receptacle unit 20 having the tubes 1 is simultaneously moved in the direction of the transfer station 60. At the same time, checking of the diameters of the tubes 1 is performed by the sensor unit 100. After first positioning 5 of the tubes 1, application of an adhesive medium onto the sleeve face of each tube 1 is performed by the adhesive bonding device 90. The position installation 80 here may have a temperature-control unit and/or a pressurized unit for applying the adhesive medium onto the tubes 1 according to defined parameters. For example, it is conceivable for the adhesive medium to be a hot-melt adhesive. The adhesive medium performs the function of enabling the material web 2 to be reliably fastened to the sleeve face of the tube 1 in the winder 50.

Figure 15:
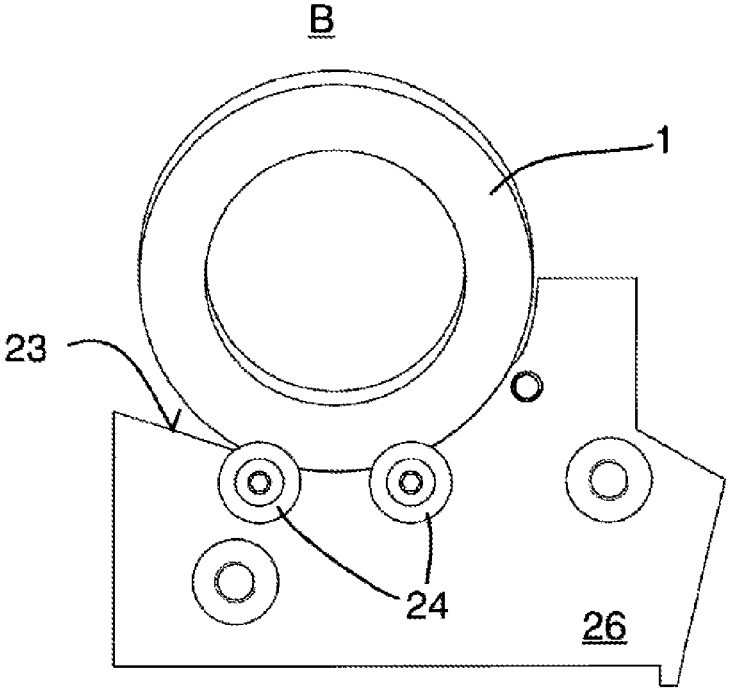
FIG. 15 shows a view B according to FIG. 12.

The tray element 26*a* according to FIG. 12 has two positioning means 24 which are at the same level and serve as stops for the central tube 1. This is also shown in FIG. 15.

The rearmost tray element 26*b* has a further positioning means 24 which is elevated in relation to the two positioning means 24. This further locking means 24 serves as a locking element for avoiding tilting during positioning of the left-hand tube 1.

Figure 2:
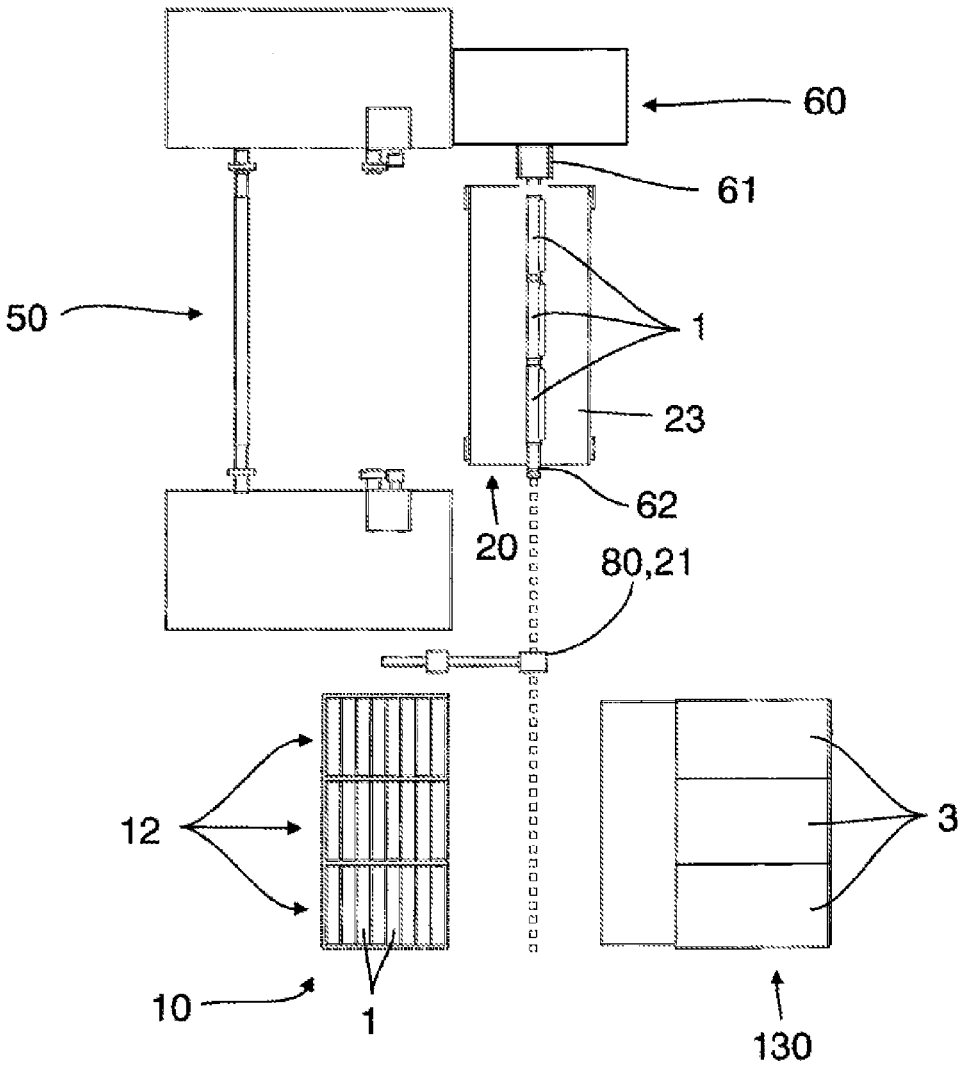
Figure 3:
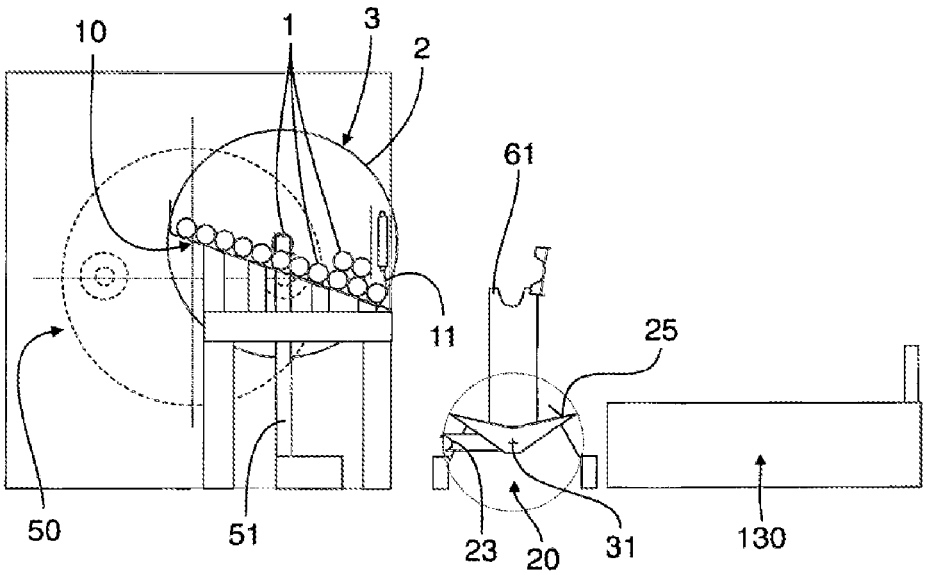
Figure 6:
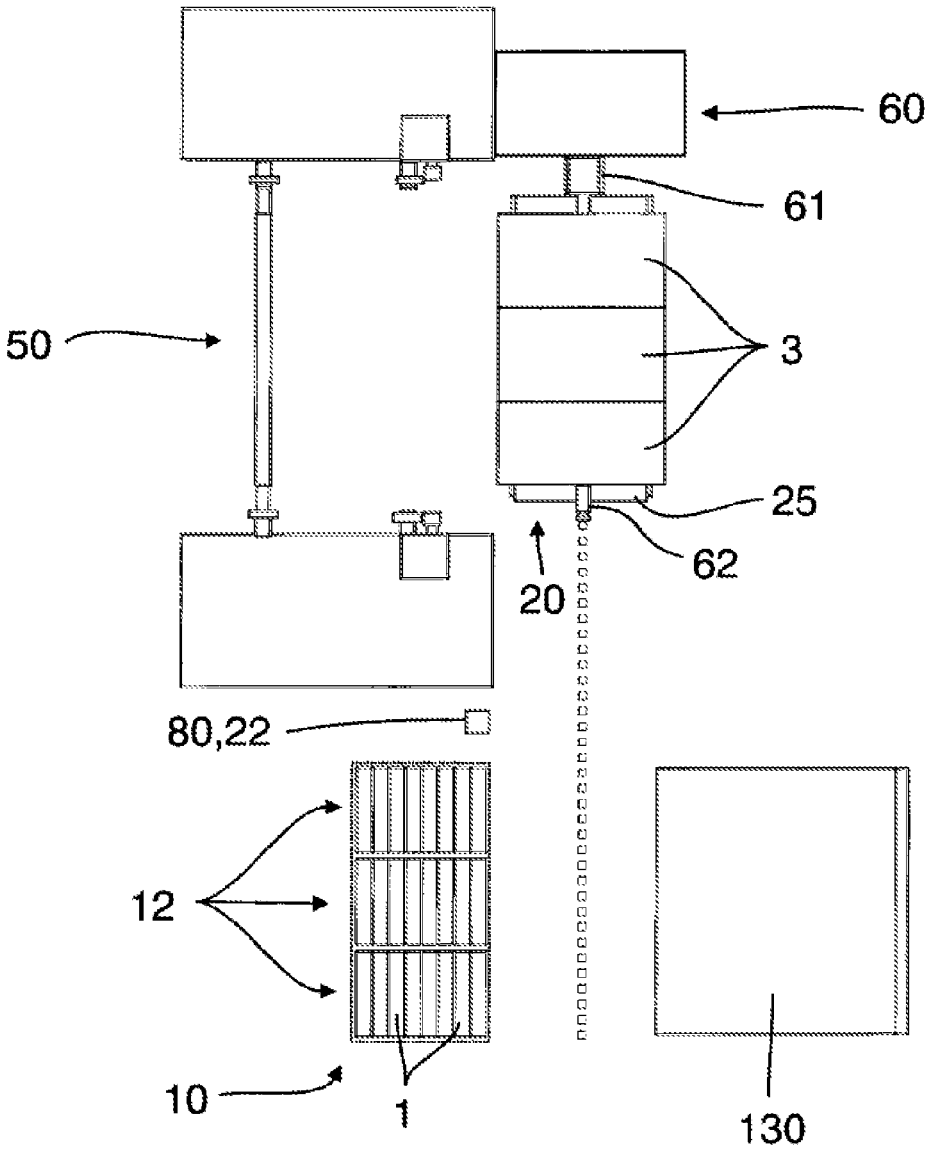
Figure 7:
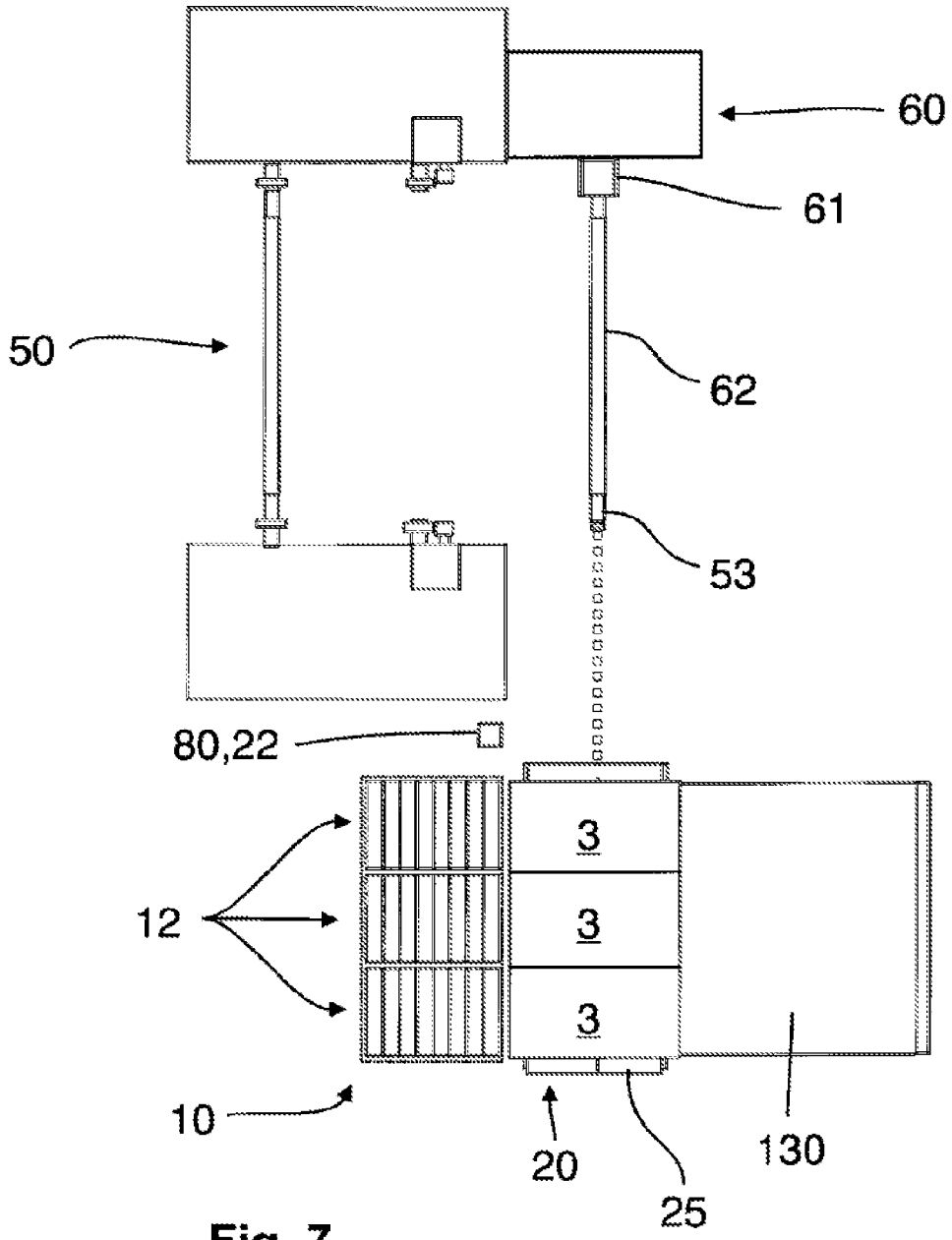

The position installation 80, on which the adhesive bonding device 90 and the sensor unit 100 are integrated, is displaceable, wherein the position installation 80 assumes an operating position 21 (shown in FIG. 12) when the receptacle unit 20 having the tubes 2 is moved in the direction of the transfer station 60 according to FIG. 2. Furthermore, the position installation 80 may be brought to a standby position which is schematically shown in FIGS. 6 and 7 and in which no application of the adhesive medium and/or checking of the diameter of the tubes 1 is required.

According to FIGS. 1 to 11 the transfer station 60 has a supporting device 61 to which a winding shaft 62 is releasably fastened. When the tubes 1 by means of the receptacle unit 20 are moved in the direction of the transfer station 60, the tubes 1 are threaded or push-fitted, respectively, onto the winding shaft 62, so that the tubes 1 reach the position in FIG. 2. The winding shaft 62 on one side is mounted on and fastened to the supporting device 61 (shown in FIGS. 16, 17, and 21). The mounting of the winding shaft 62 is disposed on that side of the supporting device 61 that faces away from the infeed unit 10. The winding shaft 62 in relation to the horizontal axis 4 here is downwardly inclined (schematically shown in FIG. 21). The winding shaft 62 in relation to the horizontal axis 4 is inclined at an angle $\alpha$, the angle $\alpha$ being less than 5°. The free end 53 of the winding shaft 62 that faces the infeed unit 10 is downwardly inclined. In order for the free end 53 to be able to be initially driven into the hollow tubes 1 when the receptacle unit 20 is moved in the direction of the transfer station 60, a guide element 29 makes for the winding shaft 62 to be briefly placed in the horizontal axis 4. The guide element 29 is disposed on the receptacle unit 20, wherein the guide element 29 may be placed between an active position 27 and a passive position 28, these positions 27, 28 being schematically shown in FIG. 21. In the active position 27 the guide element 29 places the winding shaft 62 in the horizontal axis 4, wherein the winding shaft 62 penetrates the tubes 1. According to the invention it suffices for the winding shaft 62 to have only partially penetrated one or a plurality of tubes when the receptacle unit 20 is moved in the direction of the transfer station 60. The guide element 29 may subsequently be returned to the passive position 28, so that the winding shaft 62 is moved back to its inclined position. On account thereof, a certain level of friction in relation to the inner sleeve face of the tube 1 occurs, the receptacle unit 20 having the tubes 1 being moved farther in the direction of the transfer station 60. The winding shaft 62 here acts on the tubes 1, so that the tubes 1 are in each case finally positioned at a positioning means 24 of the receptacle unit 20, this being a second positioning 6 of the tubes 1 on the first bearing face 23. The tubes 1 here are urged toward the respective positioning means 24, so that each tube 1 comes into contact with its positioning means 24, this corresponding to FIGS. 14 and 15.

Figure 21:
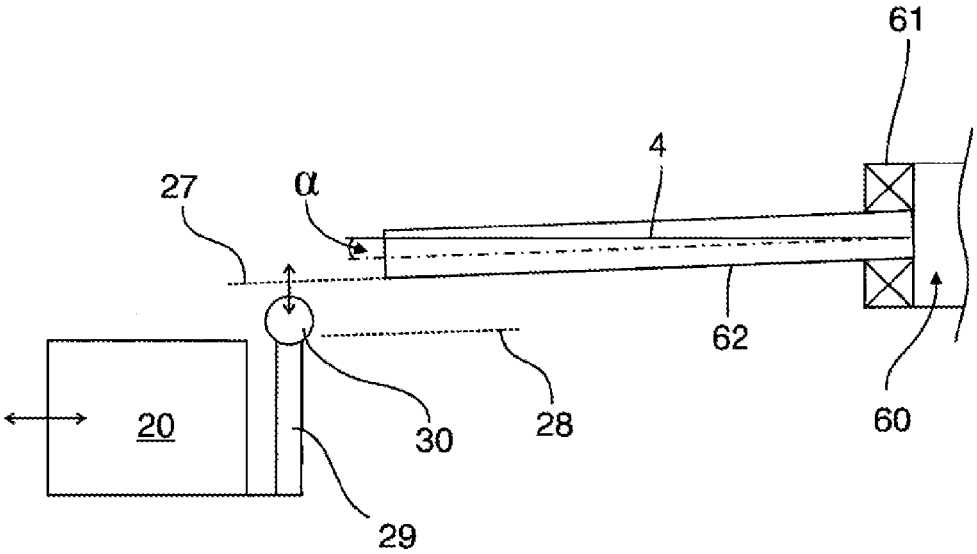
FIG. 21 shows a schematic view of the winding shaft disposed in the transfer station and of the receptacle unit.

According to FIG. 21 the guide element 29 is embodied with a roller element 30 which in the active position 27 rolls on the winding shaft 62. On account thereof, a low level of friction can be achieved with hardly any noise being developed. The roller element 30 may be embodied from a suitable plastics material.

Figure 18:
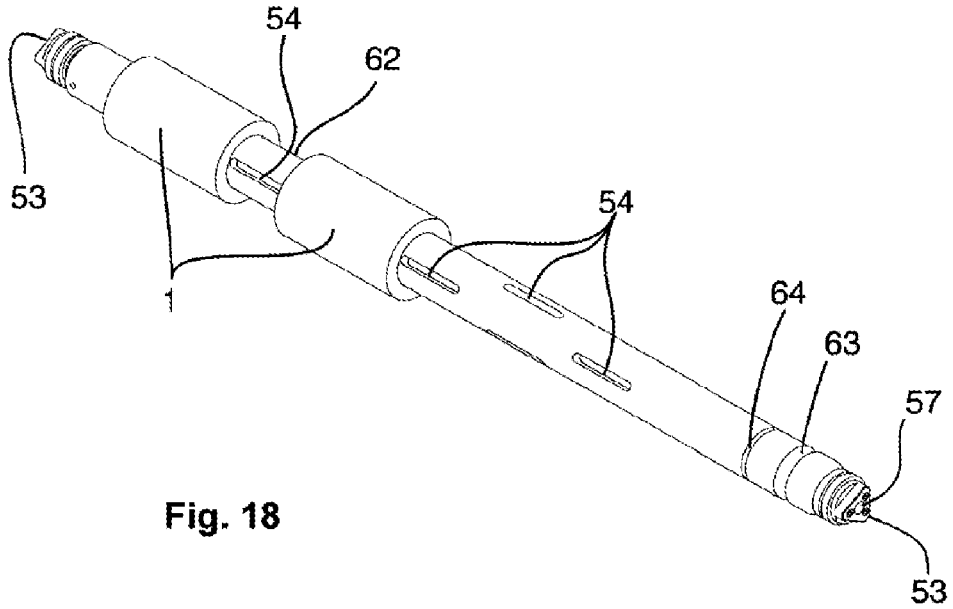
FIG. 18 shows a three-dimensional view of a winding shaft of the reel handling system.
Figure 19:
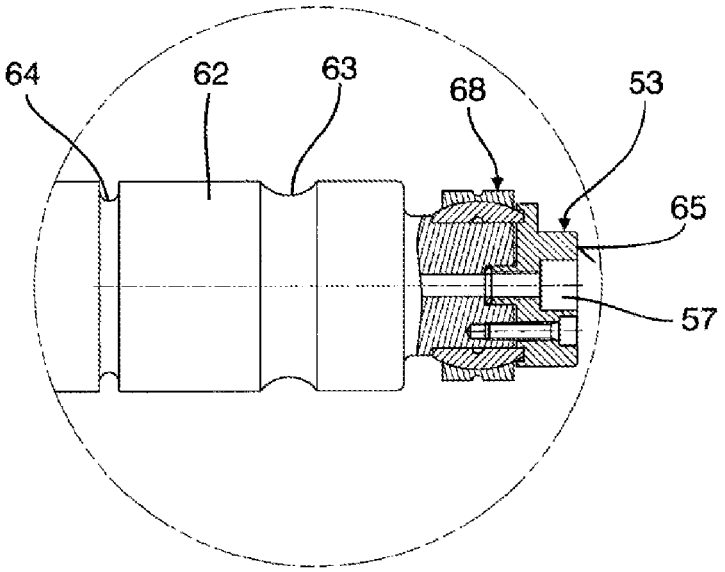
FIG. 19 shows an enlarged illustration of a part-region of the winding shaft according to FIG. 18.
Figure 20:
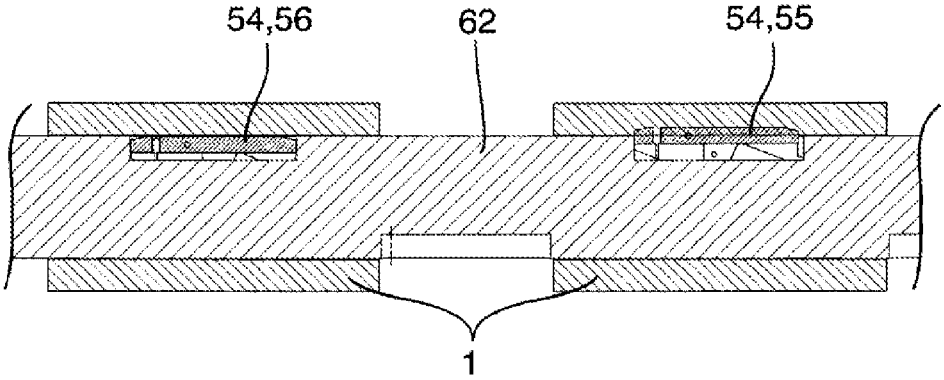
FIG. 20 shows a sectional view of the winding shaft according to FIG. 18.

In order for the tubes 1 to remain on the winding shaft 62 in a fixed manner, in particular also within the winder 50, the winding shaft 62 has fixing means 54 (shown in FIGS. 18 and 20). According to the exemplary embodiment illustrated the fixing means 54 are configured as tensioning elements which are movable on the winding shaft 62 and which are movable between a deployed state 55 and a retracted state 56. Fixing of the tubes 1 on the winding shaft 62 is performed in the deployed state 55, wherein the tensioning elements 54 in the deployed state 55 extend in a protruding manner from the winding shaft 62 and thus bear with a defined force on the inner sleeve face of each tube 1. On account thereof, additional centering of the tubes 1 on the winding shaft 62 is performed, in particular since the fixing means 54 are disposed in a uniform manner around the sleeve face of the winding shaft 62 (as is shown in FIG. 18). When the winding shaft 62 having the tubes 1 is transferred to the winder 50 and back from the winder 50 in the direction of the transfer station 60, the fixing means 54 are in their deployed state 55. The drive for moving the tensioning elements 54 to their respective state 55, 56 in the present exemplary embodiment is performed by air which is introduced into the winding shaft 62 via an air supply 57 (schematically shown in FIG. 19). The air supply 57 is axially aligned with the winding shaft 62. According to FIG. 16, the air is introduced via a nozzle 58, wherein the nozzle 58 is initially moved into the air supply 57. By way of the pressure being established within the winding shaft 62 the tensioning elements 54 are driving to the defined deployed state 55. Before the winding shaft 62 is transferred to the winder 50, the nozzle 58 which is disposed on the transfer station 60 is retracted to the position illustrated in FIG. 16. A check valve (not explicitly illustrated) prevents the fixing means 54 departing from the deployed state 55.

Figure 16:
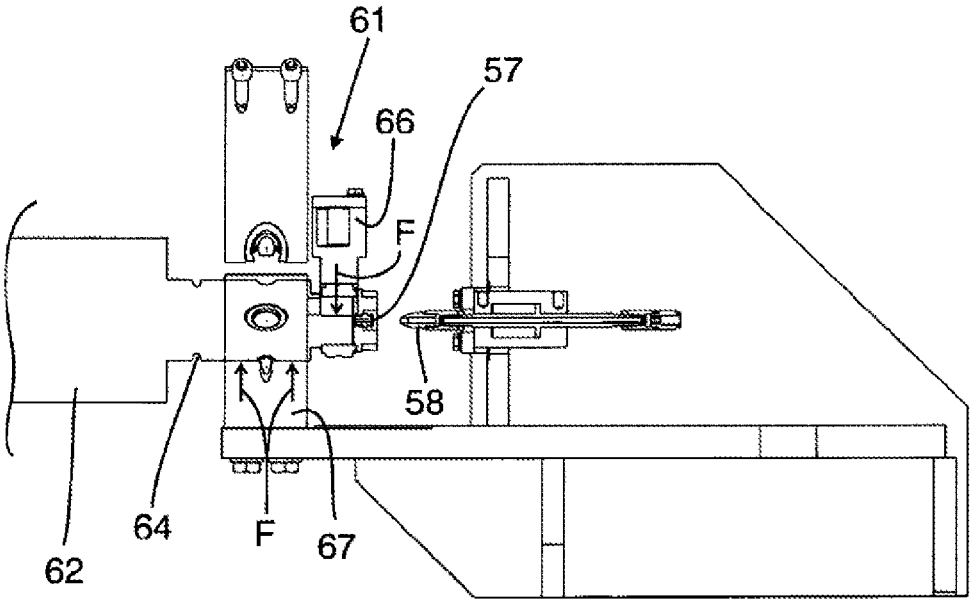
FIG. 16 shows a detailed view of the transfer station.
Figure 17:
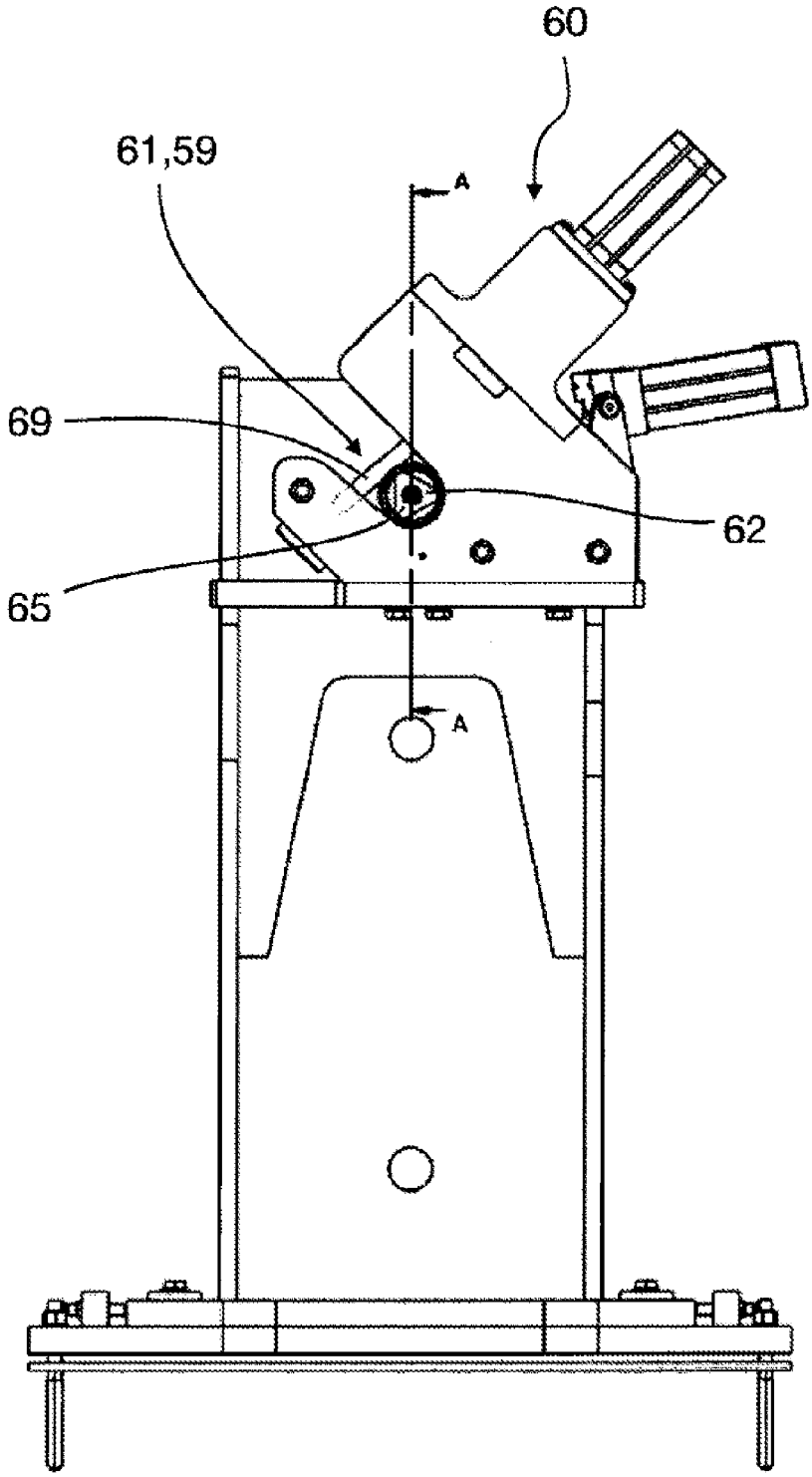
FIG. 17 shows a further view of the transfer station.

According to FIGS. 16 and 17 the supporting device 61 of the transfer station 60 which disposes of a movable bolt 60 which serves as an axial lock for the winding shaft 62, specifically when the winding shaft 62 is located in the supporting device 61 of the transfer station 60, is furthermore shown. High forces may act on the winding shaft 62 in particular when the reels 3 of FIG. 6 are pulled out in the direction of the infeed unit 10 according to FIG. 7. The axial lock 60 is then located in a locked position 59 (cf. FIG. 17), the axial lock 60 in the locked position 59 being located in a receptacle 63 according to FIG. 18. According to the illustrated exemplary embodiment the receptacle 63 is configured as a groove in the winding shaft 62.

Besides the axial lock 60, the supporting device 61 has supporting plates 66, 67 which according to the concept of a bell-crank lever act with a defined force on the winding shaft 62 (schematically shown in FIG. 16). On account thereof, it is achieved that the winding shaft 62 on one side is fastened to the transfer station 60. According to FIG. 19 the winding shaft 62 has a further receptacle 64 which is disposed so as to be adjacent to the first receptacle 63, wherein a gripper element 51 (schematically shown in FIGS. 3 to 5) of the winder 50 is insertable into the further receptacle 64. The further receptacle 54 is likewise embodied as a groove, wherein the gripper element 51 is embodied so as to correspond to the geometry of the receptacle 64 and engages in this receptacle 64 when the winding shaft 62 is moved from the transfer station 60 into the winder 50 and from the winder 50 back to the transfer station 60. During transfer the afore-described supporting device 61 is released, so that the axial lock 60 is separated from the winding shaft 62. This means that the axial lock 60 does not assume the locked position 59 but is located in a releasing position (not explicitly illustrated) in which the bolt 60 is positioned so as to be spaced apart from the winding shaft 62. The supporting plates 66, 67 also do not bear on the winding shaft 62. The winding shaft 62 is merely held by the gripper elements 51.

Figure 4:
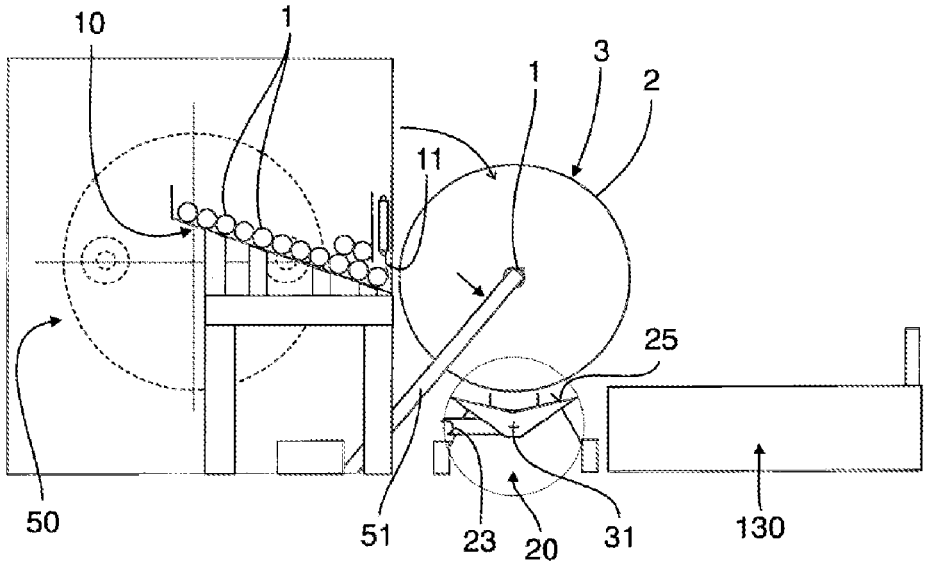
Figure 5:
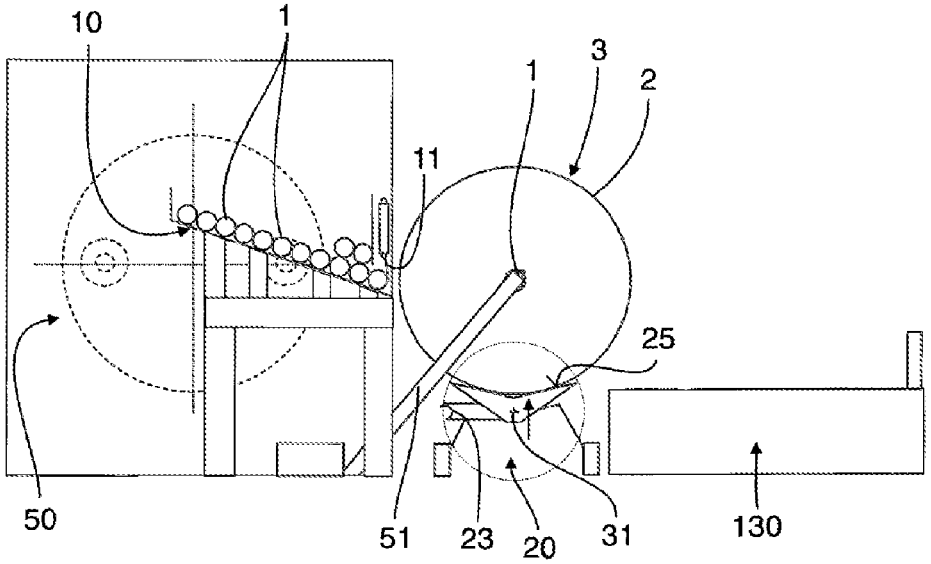
Figure 8:
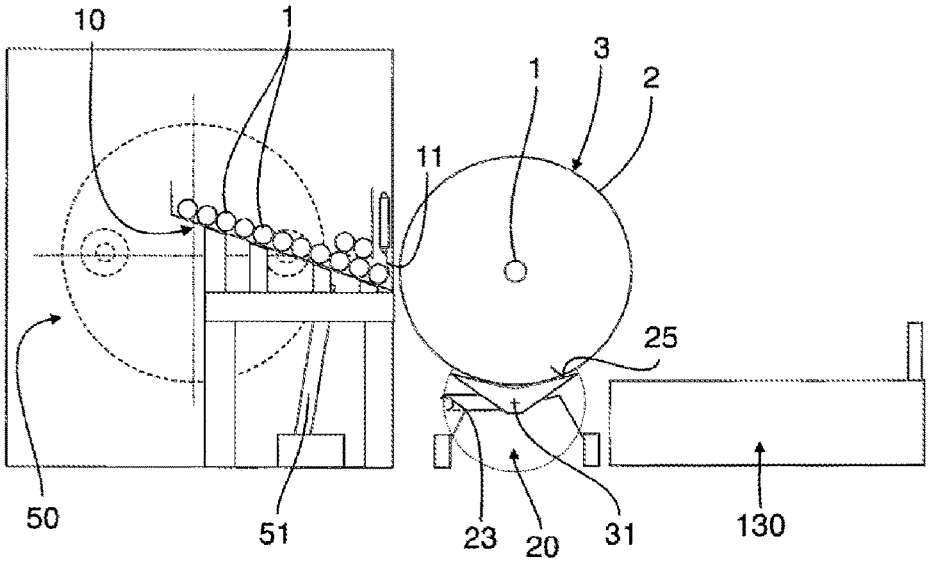
Figure 9:
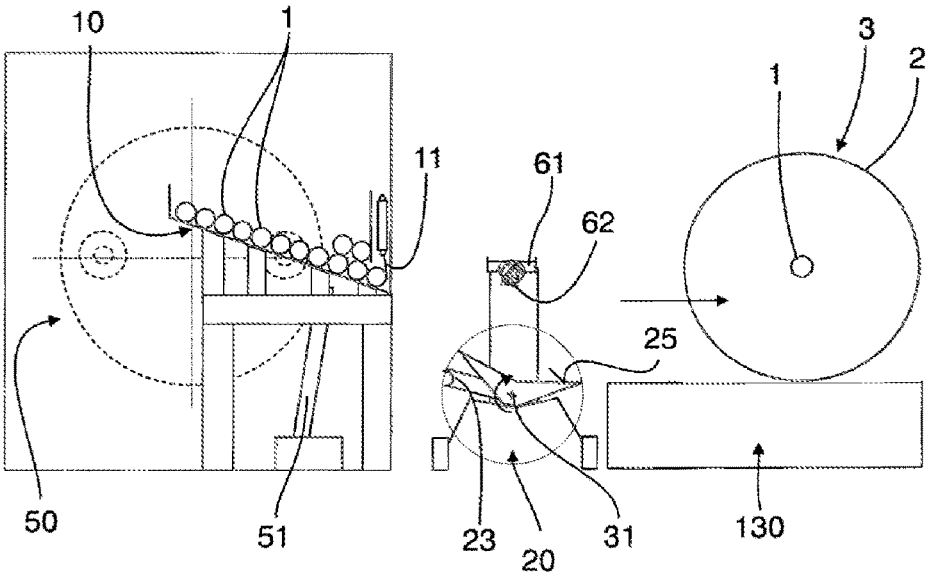
Figure 10:
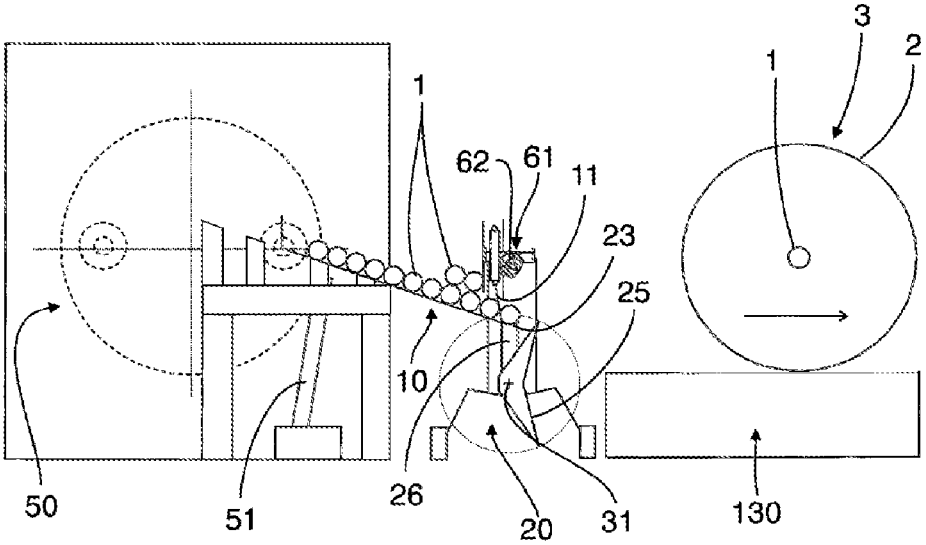
Figure 11:
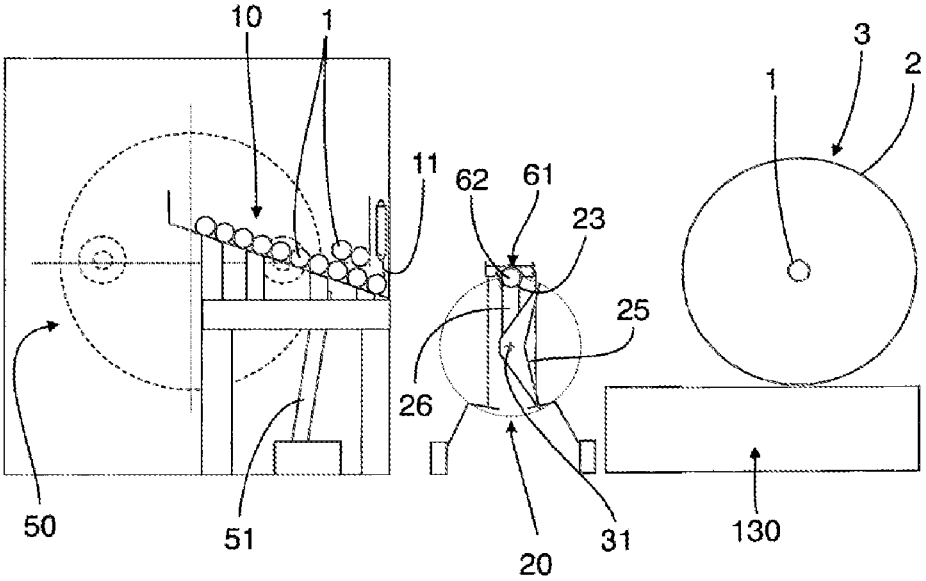

Once the reels 3 according to FIG. 4 have been transferred to the transfer station 60, an evacuation of the winding shaft 62 during which on account of the venting of air from the winding shaft 62 the tensioning elements 54 are moved into their retracted state 56 is performed. The receptacle unit 20 moves so far up to the reels 3 until contact with the material web 2 is established. Once the reels 3 reliably bear on the receptacle unit 20 the axial lock 60 is brought into its locked position 59, and the supporting plates 66, 67 are moved to their supporting position according to FIG. 16, in which the winding shaft 62 is reliably held and fixed in the supporting device 61. The gripper elements 51 which are movably disposed on the winder 50 may be released from the winding shaft 62 and be driven to a position which is shown in FIG. 8.

In order for the reels 3 to be able to be reliably received by the receptacle unit 20, the receptacle unit 20 has a second bearing face 25 which according to the illustrated exemplary embodiment is able to be moved independently of the receptacle unit 20. While the receptacle unit 20 according to FIG. 4 maintains its position, the receptacle unit 20 has a lifting device for the second bearing face 25, which can move the second bearing face 25 from its position according to FIG. 4 in the direction of the reel 3 according to FIG. 5 until the reel 3 reliably bears on the second bearing face 25. The advantage of two bearing faces 23, 25 which in size and shape are of different configuration is that the geometries of the tubes 1 and of the reels 3 are very different. Moreover, the weight of the reels 3 as compared to the weight of the tube 1 is significantly higher. It is particularly advantageous that the receptacle unit 20 is disposed so as to be rotatable about an axis 31, wherein in one rotational position the first bearing face 32 is active in order for the tubes 1 to be received (for example in FIG. 10). The second bearing face 25 here is deactivated and without function. In a further rotational position of the receptacle unit 20 the second bearing face 25 is active (shown in FIG. 5, for example), so as to reliably receive the reels 3. The first bearing face 23 here is deactivated.

According to FIG. 19 it is furthermore shown that the air supply 57 which simultaneously may also serve as an air extraction during venting is disposed on the end face 54 of the winding shaft 62. The end face 65, as shown in FIG. 18, here is embodied as a three-edged wedge. The three-edged wedge has the advantage that high torques can be accommodated in the winder 50.

According to the illustrated exemplary embodiment according to FIG. 19 the winding shaft 62 has a tilt protection which is implemented in the form of a pendulum bearing 68 which is movably disposed at the periphery of the winding shaft 62. The pendulum bearing 68 is embodied from a plastics material and may prevent tilting of the winding shaft 62 when flexing occurs in the winding shaft 62.

If and when the receptacle unit 20 having the reels 3 has arrived at the position according to FIG. 7, the receptacle unit 20 rotates about the axis 31. The second bearing face 25 in particular rotates about the axis 31, wherein the reels 3 are infed to a reel discharge 130 (cf. FIG. 9). The next cycle for adding tubes commences, wherein according to FIG. 10 the infeed unit 10 approaches the receptacle unit 20 and further tubes 1 are infed to the first bearing face 23. The infeed unit 10 has a singularizing element 11 which effects that only one tube 1 is infed to the receptacle unit 20 from a duct 12 of the infeed unit 10. Advantageously, all functional units of the reel handling system, in particular the infeed unit 10, the singularizing elements 11, the receptacle unit 20 having its bearing faces 23, 25, the guide element 29, the transfer station 60, the supporting device 61, the fixing means 54, the axial lock 60, the supporting plates 66, 67, the position installation 80, and the reel discharge 130 are electronically interconnected by a controller unit so that a mutual exchange of data may take place. On account thereof, the reel handling system may be further optimized in terms of efficiency. The winder 50 may also communicate data with the controller unit; the controller unit may in particular be integrated in the winder 50. Moreover, the infeed unit 10 is configured in such a manner that the ducts 12 according to FIG. 1 or FIG. 2 in terms of their width are adjustable to the geometry of the tube 1; it is in particular conceivable for the infeed unit 10 to be further configured in such a manner that the number of ducts may be varied.

The exemplary embodiment of the reel handling system shown is particularly advantageous since on account of the arrangement of the individual functional units the winder 50 is accessible and visible to the operator (shown by the arrows according to FIG. 1). This is achieved inter alia in that the supporting device 61 is laterally disposed, so as to be opposite the infeed unit 10 or the reel discharge 130, respectively, wherein the winding shaft 62 on one side is releasably held on the supporting device 61.

While the material webs 2 are applied onto the tubes 1 in the winder 50, a reel 3 having in each case one material web 2 is created, wherein the material webs 2 are applied onto various tubes 1 which lie beside one another. The reels 3 are subsequently returned to the transfer station 60. Prior to the material web 2 being applied onto the tube 1, the material web 2 advantageously has a larger width than the direction of extent of the tube 1. This unfinished material web (not explicitly shown) in an upstream step is separated to form the individual material webs 2, this being performed by either a cutting blade or a cutting disk. The step of separating may be performed within the winder 50, for example.

The gripper elements 51 which act laterally on the winding shaft 62 in terms of their length may be driven in or out in a translatory manner and be pivoted about a defined axis, this being schematically shown in FIGS. 3 to 5 or FIG. 8, respectively. On account thereof, the winding shaft 62 can be positioned in a precisely targeted manner.

LIST OF REFERENCE SIGNS

1 Tube
2 Material web
3 Reel
4 Horizontal axis
5 First positioning
6 Second positioning
10 Infeed unit
11 Singularizing element
12 Duct
20 Receptacle unit
21 Operating position
22 Standby position
23 First bearing face
24 Positioning means
25 Second bearing face
26 Tray element
27 Active position
28 Passive position
29 Guide element
30 Roller element
31 Axis of the receptacle unit
50 Winder
51 Gripper element
53 Free end
54 Fixing means, tensioning element
55 Deployed state
56 Retracted state
57 Air supply/Air extraction
58 Nozzle
59 Locked position
60 Transfer station
61 Supporting device
62 Winding shaft
63 Receptacle
64 Receptacle
65 End face
66 Supporting plate
67 Supporting plate
68 Pendulum bearing
69 Bolt, axial lock
80 Position installation
81 Wiper element
90 Adhesive bonding device
100 Sensor unit
110 First sensor
120 Second sensor
130 Reel discharge

What is claimed is:

1. A reel handling system for a winder (50) which is impingeable with tubes (1) having in each case one material web (2), such that a plurality of reels (3) of tubes (1) having in each case one material web (2) wound thereon are created, the reel handling system having an infeed unit (10) for transferring a plurality of tubes (1) to a receptacle unit (20), wherein the receptacle unit (20) is disposed so as to be movable between the infeed unit (10) and a transfer station (60) by way of which tubes (1) are consignable to the winder (50) and reels (3) is transferable from the winder (50) to the transfer station (60), wherein a position installation (80) which effects positioning of the tubes (1) when the receptacle unit (20) is moved in the direction of the transfer station (60) is provided between the transfer station (60) and the infeed unit (10);

wherein for applying an adhesive medium to the tubes (1) an adhesive bonding device (90) is disposed between the infeed unit (10) and the transfer station (60), and wherein a sensor unit (100) is disposed between a wiper element (81) and the adhesive bonding device (90).

2. The reel handling system as claimed in claim 1, characterized in that the position installation (80) is configured in such a manner that positioning of the tubes (1) is performed in a mutually relative manner.

3. The reel handling system as claimed in claim 1, characterized in that the adhesive bonding device (90) is integrated in the position installation (80).

4. The reel handling system as claimed in claim 1, characterized in that the position installation (80) has a sensor unit (100) which checks the tubes (1) passing by, checks whether the tubes (1) bear correctly on the receptacle unit (20) and/or the correct tubes (1) are located on the receptacle unit (20).

5. The reel handling system as claimed in claim 1, characterized in that the position installation (80) has a wiper element (81) which serves for contacting at least one tube (1) while the receptacle unit (20) is moved in the direction of the transfer station (60).

6. The reel handling system as claimed in claim 1, characterized in that the position installation (80) is displaceable, and assumes an operating position (21) when the receptacle unit (20) having the tubes (1) is moved in the direction of the transfer station (60), and assumes a standby position (22) which differs from the operating position (21), when the receptacle unit (20) having the reels (3) is moved.

7. The reel handling system as claimed in claim 1, characterized in that a reel discharge (130) to which reels (3) for conveying away are infeedable from the receptacle unit (20) is provided.

8. The reel handling system as claimed in claim 1, characterized in that the transfer station (60) has a supporting device (61) on which a winding shaft (62) is releasably fastened, wherein the tubes (1) are capable of being push-fitted onto the winding shaft (62) when the receptacle unit (20) is moved in the direction of the transfer station (60).

9. The reel handling system as claimed in claim 8, characterized in that the winding shaft (62) on one side is mounted on and/or fastened to the supporting device (61).

10. The reel handling system as claimed in claim 9, characterized in that the mounting of the winding shaft (62) is disposed on that side of the supporting device (61) that faces away from the infeed unit (10).

11. The reel handling system as claimed in claim 8, characterized in that the winding shaft (62) in relation to the horizontal axis (4) is downwardly inclined, such that the winding shaft (62) in relation to the horizontal axis (4) is inclined at an angle $\alpha$, wherein the angle $\alpha$ is $\leq 5°$.

12. The reel handling system as claimed in claim 8, characterized in that a free end (53) of the winding shaft (62) that faces the infeed unit (10) is downwardly inclined.

13. The reel handling system as claimed in claim 1, characterized in that the position installation (80) has a temperature-control unit for the adhesive medium and/or a pressurized unit for applying the adhesive medium, wherein the adhesive medium is a hot-melt adhesive.

14. The reel handling system as claimed in claim 1, characterized in that the receptacle unit (20) has a first bearing face (23) having positioning means (24), so as to align the tubes (1) in the receptacle unit (20) by means of the position installation (80).

15. The reel handling system as claimed in claim 1, characterized in that the receptacle unit (20) has a second bearing face (25) for receiving the reels (3), in that the second bearing face (25) is movable independently of the receptacle unit (20).

16. The reel handling system as claimed in claim 1, characterized in that the receptacle unit (20) is movable in a linear manner between the infeed unit (10) and the transfer station (60), and/or has a lifting device by way of which the receptacle unit (20) is movable in a perpendicular manner to the direction of movement between the infeed unit (10) and the transfer station (60).

17. The reel handling system as claimed in claim 1, characterized in that the receptacle unit (20) is disposed so as to be rotatable about an axis (31).

18. A method for positioning tubes (1) in a reel handling system as claimed in claim 1, the reel handling system having an infeed unit (10) for transferring a plurality of tubes (1) to a receptacle unit (20), wherein the receptacle unit (20) is disposed so as to be movable between the infeed unit (10) and a transfer station (60), and a position installation (80) which effects positioning of the tubes (1) when the receptacle unit (20) is moved in the direction of the transfer station (60) is provided between the transfer station (60) and the infeed unit (10).

19. The method as claimed in claim 18, characterized in that a winding shaft (62) is releasably fastened to the transfer station (60), wherein the tubes (1) are push-fitted onto the winding shaft (62) when the receptacle unit (20) is moved in the direction of the transfer station (60) and final positioning of the tubes (1) on the winding shaft (62) is hereby performed.

* * * * *